US011255228B2

(12) United States Patent
Hedman

(10) Patent No.: US 11,255,228 B2
(45) Date of Patent: Feb. 22, 2022

(54) METHOD AND DEVICE FOR ELECTRICALLY CONTROLLING A VALVE ACTUATOR IN AN INTERNAL COMBUSTION ENGINE

(71) Applicant: Hedman Ericsson Patent AB, Flen (SE)

(72) Inventor: Mats Hedman, Sparreholm (SE)

(73) Assignee: Hedman Ericsson Patent AB, Flen (SE)

( * ) Notice: Subject to any disclaimer, the term of this patent is extended or adjusted under 35 U.S.C. 154(b) by 0 days.

(21) Appl. No.: 17/295,743

(22) PCT Filed: Nov. 8, 2019

(86) PCT No.: PCT/SE2019/051132
§ 371 (c)(1),
(2) Date: May 20, 2021

(87) PCT Pub. No.: WO2020/022949
PCT Pub. Date: Jan. 30, 2020

(65) Prior Publication Data

US 2021/0355848 A1 Nov. 18, 2021

(30) Foreign Application Priority Data

Dec. 10, 2018 (SE) ..... 1851534-6

(51) Int. Cl.
*F01L 1/18* (2006.01)
*F01L 9/21* (2021.01)

(52) U.S. Cl.
CPC ..... *F01L 9/21* (2021.01); *F01L 2009/2107* (2021.01); *F01L 2009/2134* (2021.01)

(58) Field of Classification Search
CPC ..... F01L 9/21; F01L 2009/2134; F01L 2009/2107
USPC ..... 123/90.11
See application file for complete search history.

(56) References Cited

U.S. PATENT DOCUMENTS 5,074,259 A 12/1991 Pusic
6,116,570 A * 9/2000 Bulgatz ..... F16K 31/0679 251/129.1
6,354,253 B1 3/2002 Katsumata et al.
2007/0044741 A1 3/2007 Daniel

OTHER PUBLICATIONS

International Search Report and Written Opinion regarding PCT/SE2019/051132, dated Jan. 17, 2020, 8 pps.

* cited by examiner

*Primary Examiner* — Zelalem Eshete
(74) *Attorney, Agent, or Firm* — Foley & Lardner LLP

(57) ABSTRACT

The present invention concerns a method for electrically controlling a valve actuator in a 2-stroke or 4-stroke engine, where the actuator comprises a first solenoid (A) with a plunger (5) and a second solenoid (B) with a plunger (15), wherein the engine has at least one cylinder (1) with at least one freely controllable engine valve comprising a valve disc (10) with associated valve stem (11) and a valve spring (4) and where air is introduced, or exhaust gases are evacuated from, a combustion chamber (3) past a lower part of the valve stem with the valve disc via at least one channel (2) in the cylinder, wherein the valve actuator is activatable to open the engine valve. The invention is characterized in that both the first and second solenoid are activated during opening of the engine valve.

20 Claims, 10 Drawing Sheets

METHOD AND DEVICE FOR ELECTRICALLY CONTROLLING A VALVE ACTUATOR IN AN INTERNAL COMBUSTION ENGINE

TECHNICAL FIELD

The present invention concerns a method and a device for a freely controllable electrically activated valve actuator for controlling the gas flow in 2- or 4-stroke engines.

BACKGROUND

Freely controllable valves allow improved efficiency and substantially reduced emissions, i.e. cleaner exhaust gases. Valve actuators for such freely controllable valves may be pneumatically or hydraulically activated.

Today's valve actuators for freely controllable engine valves often have high energy consumption and/or complex construction and/or have difficulties in quickly closing and opening the valve, i.e. to achieve a short duration.

SUMMARY

The purpose of the invention is to achieve a new actuator technology in the form of an electrically controlled electromechanical valve actuator which is principally simple in its construction, energy efficient and which is capable of quickly opening and closing an engine valve in a cylinder head of an engine. This purpose is achieved by providing the invention with the features described in the patent claims.

According to a first aspect of the invention, there is provided a method for electrically controlling a valve actuator in a 2-stroke or 4-stroke combustion engine, where the actuator comprises a first solenoid with a first plunger and a second solenoid with a second plunger. The engine has at least one cylinder with at least one freely controllable engine valve comprising a valve disc with associated valve stem and a valve spring and where air is introduced, or exhaust gases are evacuated from, a combustion chamber past a lower part of the valve stem with the valve disc via at least one channel in the cylinder, wherein the valve actuator is activatable to open the engine valve. The method is characterized in that both the first and the second solenoid are activated during opening of the engine valve.

In embodiments, the first and second plungers together act on the valve stem during initial opening movement of the engine valve.

In embodiments, the first and second solenoids are arranged in series, preferably such that the first plunger, during the initial opening movement of the engine valve, acts on the second plunger, which in turn acts on the valve stem. The valve spring is preferably arranged to keep the engine valve closed, i.e. to apply a force on the engine valve in such a direction that the valve disc is pressed in the direction of the valve seat. In such an embodiment, the solenoids together act on the valve during opening to overcome the force of the valve spring.

The technology involves using at least two solenoids and an engine valve spring which in a traditional manner keeps an engine valve closed and using a here-called "soft hammer effect" when the engine valve is to be opened.

The first and second plungers are each provided with a stop defined as the position at which respective solenoid exerts maximum force on the plunger.

In embodiments, the for instance two solenoids are arranged in series with each other, wherein the first solenoid has a short stroke and a high strength already at activation compared with the second solenoid which has a long stroke and is weak at activation. In other words, the first solenoid has a shorter stroke and higher strength that the second solenoid. The strengths of both solenoids, i.e. the force with which respective plunger may act, increases as the respective plunger is moved further into the magnetic field until they are completely surrounded in their respective magnetic field. The at least two solenoids are activated together. The plunger of the first solenoid pushes on the plunger of the second solenoid with a strong and even stronger force during its relatively short stroke, which thereby leads to the mentioned soft hammer effect. The plunger of the second solenoid is coupled to, or rests on, the valve stem of an engine valve and acts with pushing force thereon together with the plunger of the first solenoid. When the plunger of the first solenoid has reached its stop, the plunger of the second solenoid has reached sufficiently long into its magnetic field such that the plunger with strong and increasing force acts on the valve stem during further movement of the plunger towards the stop until the stop is reached when the engine valve is fully open.

A problem with using solenoids for opening engine valves is that they need to be strong to overcome the force of the mechanical spring, the engine valve spring, which keeps the valve closed. A disadvantage is that with high strength comes with great size and weight of the moving iron core, the plunger, whose force is to overcome the closing force of the engine valve spring. The weight of the iron core and the valve spring together with the force of the valve spring contravenes the possibility for a short duration, i.e. a short time from that the valve is closed until it is fully open and once again closed. In embodiments, the method comprises that, when the plunger of the first solenoid has reached its stop in the first solenoid, the plunger of the second solenoid continues to act on the valve stem until the plunger of the second solenoid has reached its stop in the second solenoid. In this embodiment, the mass of the iron core in the first solenoid will not be involved during a substantial part of the duration. By means of this method, a significantly short duration is made possible.

The invention is not departed from by placing another solenoid in series with the above described two solenoids. For example, an additional solenoid may be placed before the above mentioned first solenoid. Preferably, this solenoid has a substantially shorter stroke and is substantially stronger than the above mentioned first solenoid.

In embodiments, the first and/or the second solenoid is/are activated just before the engine valve reaches the valve seat, such that the closing movement is retarded. The activation is preferably of short duration, i.e. during a predetermined time period. The activation is preferably started at a predetermined time before the engine valve reaches the valve seat.

According to a second aspect of the invention, there is provided a device for electrically controlling a valve actuator in a 2-stroke or 4-stroke combustion engine, where the actuator comprises a first solenoid with a first plunger and a second solenoid with a second plunger, wherein the engine has at least one cylinder with at least one freely controllable engine valve comprising a valve disc with associated valve stem and a valve spring and where air is introduced, or exhaust gases are evacuated from, a combustion chamber past a lower part of the valve stem with the valve disc via at least one channel in the cylinder, wherein the valve actuator is arranged activatable to open the engine valve. The device is characterized in that both the first and second solenoid are activated during opening of the engine valve. In embodiments, the device is formed as an engine control system.

According to a third aspect of the invention, there is provided a valve actuator for a 2-stroke or 4-stroke combustion engine, where the valve actuator comprises a first solenoid with a first plunger and a second solenoid with a second plunger, wherein the combustion engine has at least one cylinder with at least one freely controllable engine valve comprising a valve disc with associated valve stem and a valve spring, wherein air is introduced, or exhaust gases are evacuated from, a combustion chamber past a lower part of the valve stem with the valve disc via at least one channel in the cylinder, wherein the valve actuator is arranged activatable to open the engine valve. The valve actuator is characterized in that the first and second solenoids are arranged to both be activated during opening of the engine valve.

According to a fourth aspect of the invention, there is provided a valve arrangement for a 2-stroke or 4-stroke combustion engine having at least one cylinder with at least one freely controllable engine valve comprising a valve disc with associated valve stem and a valve spring, wherein air is introduced, or exhaust gases are evacuated from, a combustion chamber past a lower part of the valve stem with the valve disc via at least one channel in the cylinder, wherein the valve arrangement comprises a valve actuator according to the third aspect of the invention and said freely controllable engine valve. In embodiments, the valve arrangement also comprises a device according to the second aspect of the invention.

According to a fifth aspect of the invention, there is provided a 2-stroke or 4-stroke combustion engine comprising at least one cylinder with at least one freely controllable engine valve comprising a valve disc with associated valve stem and a valve spring, wherein air is introduced, or exhaust gases are evacuated from, a combustion space past a lower part of the valve stem with the valve disc via at least one channel in the cylinder. The combustion engine further comprises a valve actuator according to the third aspect of the invention. In embodiments, the combustion engine also comprises a device according to the second aspect of the invention.

Above described embodiments of the method are applicable also as corresponding embodiments of the second, third, fourth and fifth aspects of the invention.

BRIEF DESCRIPTION OF THE DRAWINGS

The invention shall now be described with embodiments, where FIGS. 1-4 schematically show an actuator where an engine valve is opened using a so called "hammer effect" described in an earlier filed patent application. Thereafter, FIGS. 5-10 relating to the present invention are described.

The reasons for first describing said

DETAILED DESCRIPTION

In the description below, it is assumed that there is a computer based engine control system with required sensors for crank angle degree and electronics for reading crank angle degree and controlling required solenoids and so on. These components therefore do not need to be described. This also applies for existing spark plugs, fuel injectors, combustion chambers, cylinder walls and piston.

Figure 1:
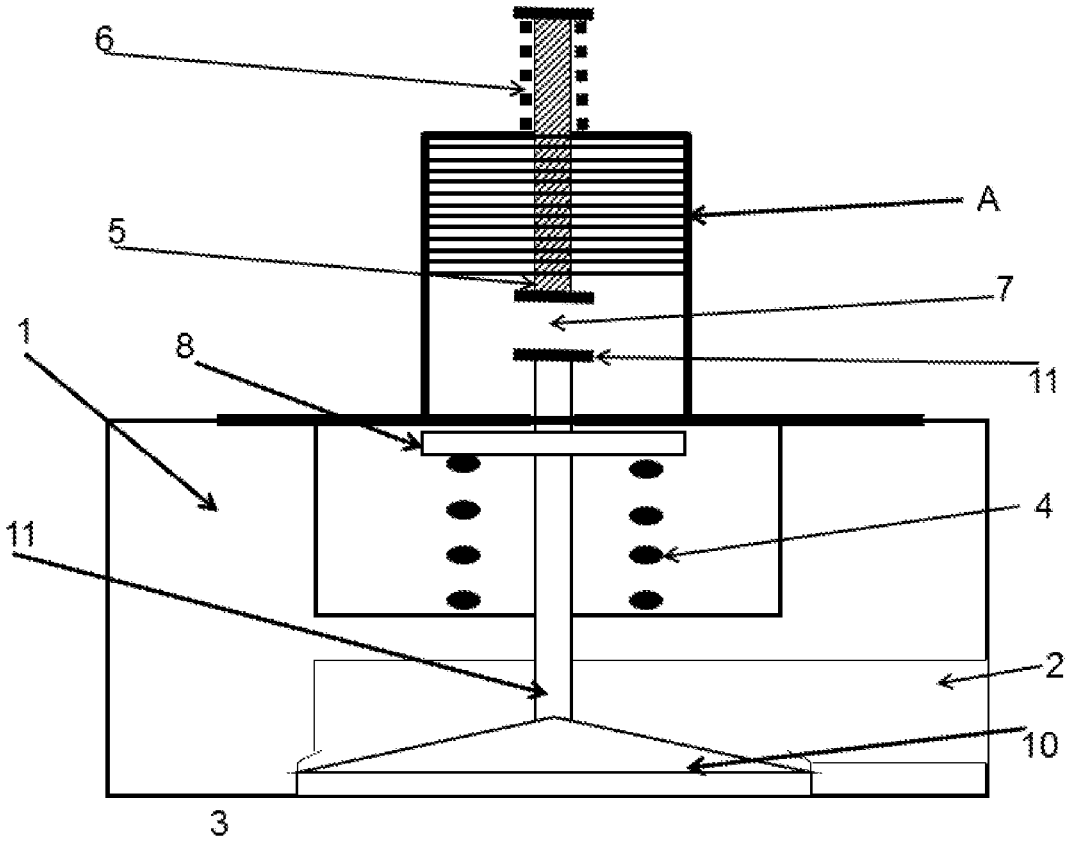
FIGS. 1-4 is to clarify the difference between the two inventions, the difference between opening an engine valve with "hammer effect" and "soft hammer effect". Furthermore, the description of FIGS. 5-10 may be simplified while maintaining clarity.

FIG. 1 shows an initial position during turned-off engine with a partially cut view from the side of a cylinder head 1 with a channel 2 for introduction of air, with or without fuel, to, or evacuation of exhaust gases from, a combustion chamber 3 past a conventional valve disc 10. An engine valve consists of the valve disc with valve stem 11.

The engine valve is kept closed in a conventional manner using a spring 4, and a conventional spring washer 8 keeps the spring in place with certain pretension. Furthermore, a solenoid A with an iron core, plunger 5 is shown. A spring 6 retains the plunger 5 in a home position when the solenoid A is not activated. There is a distance 7, an acceleration distance, between the upper portion of the valve stem 11 and the lower portion of the plunger 5. Although not illustrated in the figure, it is understood that the plunger has a large mass. When the plunger is wholly or partially disposed in the solenoid, the portion of the plunger being in the solenoid is surrounded by a winding of copper wire. When electricity is fed to the winding, a magnetic field is generated which attracts or repels the plunger. In this case, the plunger is attracted by the surrounding magnetic field, but the opposite could be the case while still being within the scope of the invention. A plunger is provided with an existing stop in the solenoid, being a natural stop where its force is at its maximum. Although not illustrated, it is understood that such a stop is present.

Figure 2:
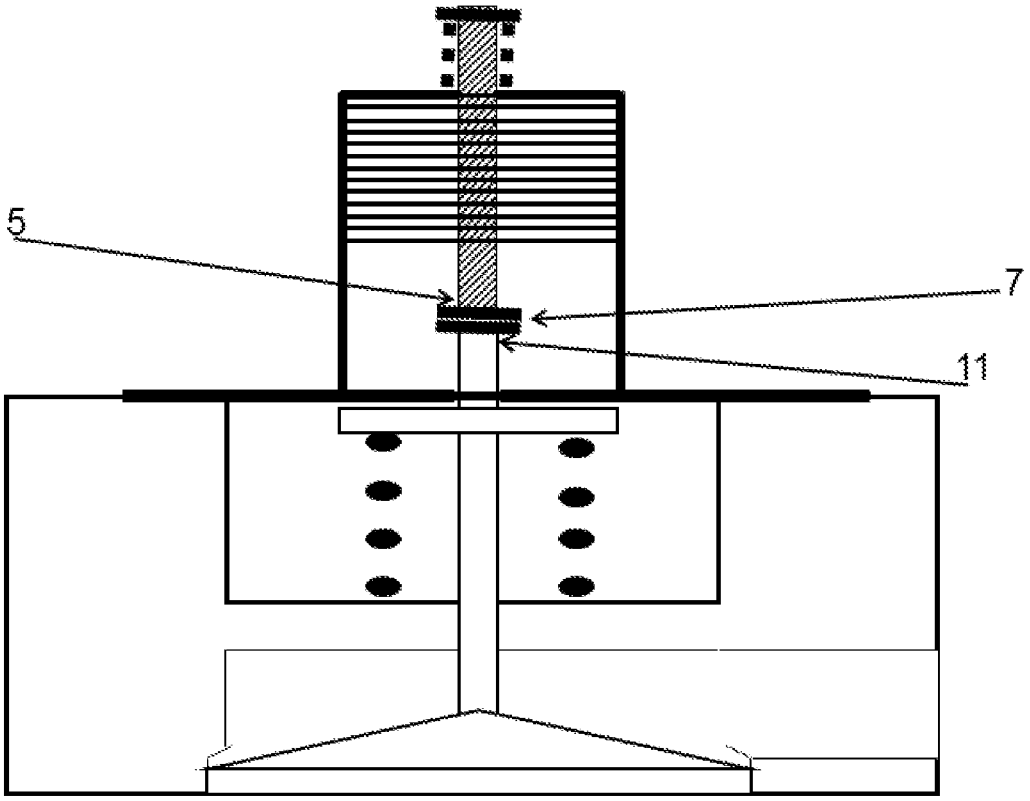

FIG. 2 shows the engine valve in a still closed position, for instance before the engine is started. The solenoid A has been activated and the plunger 5 has been accelerated while moving along distance 7 to the point where it hits the upper end of valve stem 11, whereby the kinetic energy of the plunger almost instantaneously is transferred to the valve stem, the "hammer effect".

Figure 3:
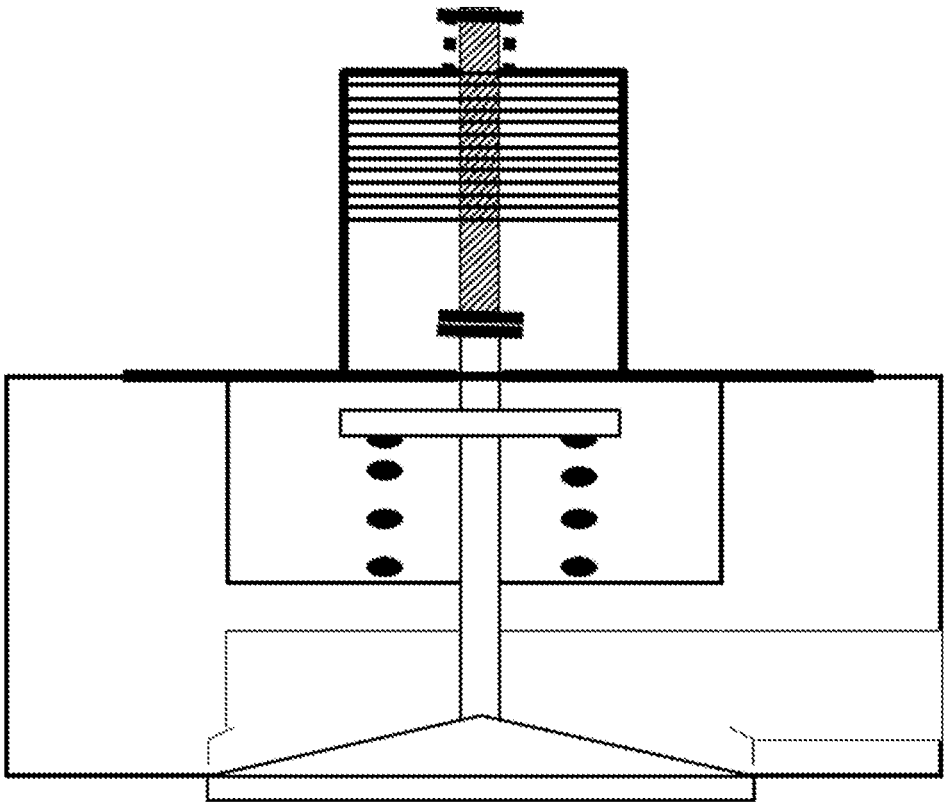

FIG. 3 shows the engine valve at the onset of an opening movement. The plunger has transferred most of its kinetic energy to the engine valve, whose movement towards an open position is undergoing heavy acceleration. The movement of the plunger continues for another short distance until the plunger reaches its natural stop in the solenoid.

Figure 4:
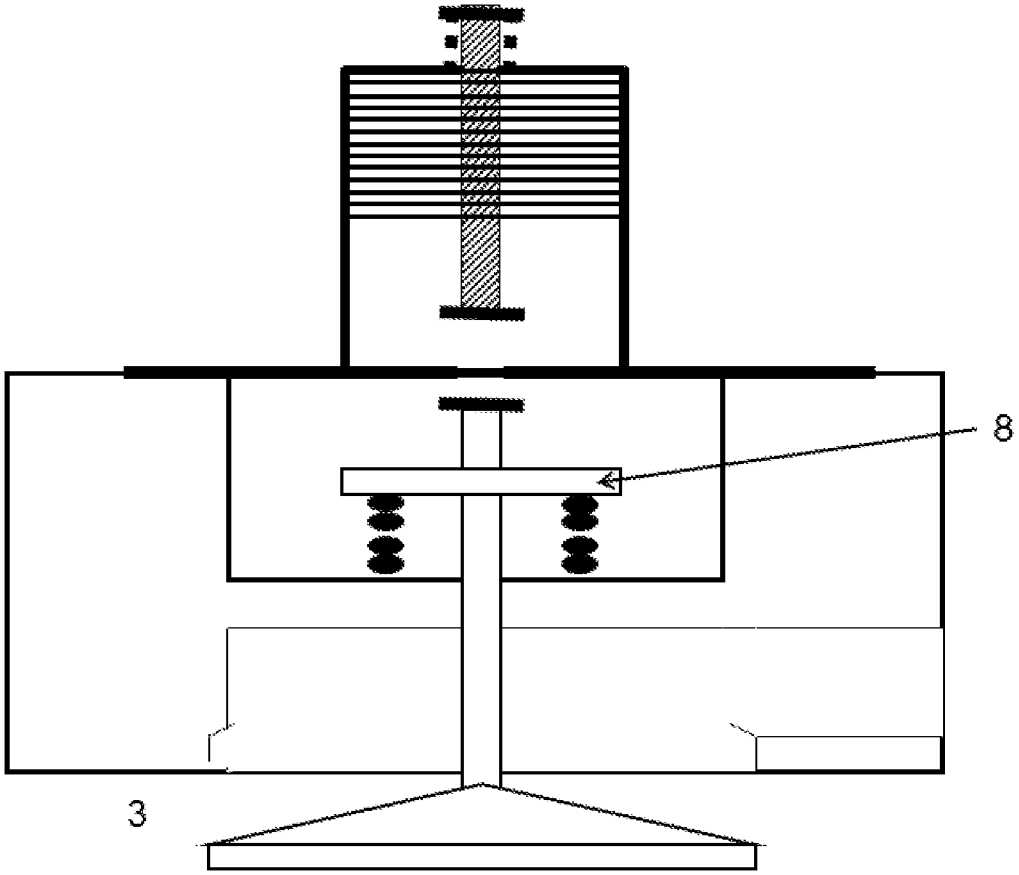

FIG. 4 shows the engine valve in fully open position where it turns. It is apparent that the only moving mass in this stage is the lowest possible mass consisting of the engine valve with its stem, spring washer and spring. The shortest possible duration is achieved. It is common that the moving mass of the spring is considered to constitute about one third of the spring weight.

FIGS. 5-9 thus concern the present invention, and the description of these figures can be simplified in that mainly added features and functions compared to FIGS. 1-4 are explained. For instance, it is understood that the cylinder head, the valve disc etc. which is present in the above described figures are also present in the description of the figures below.

Figure 5:
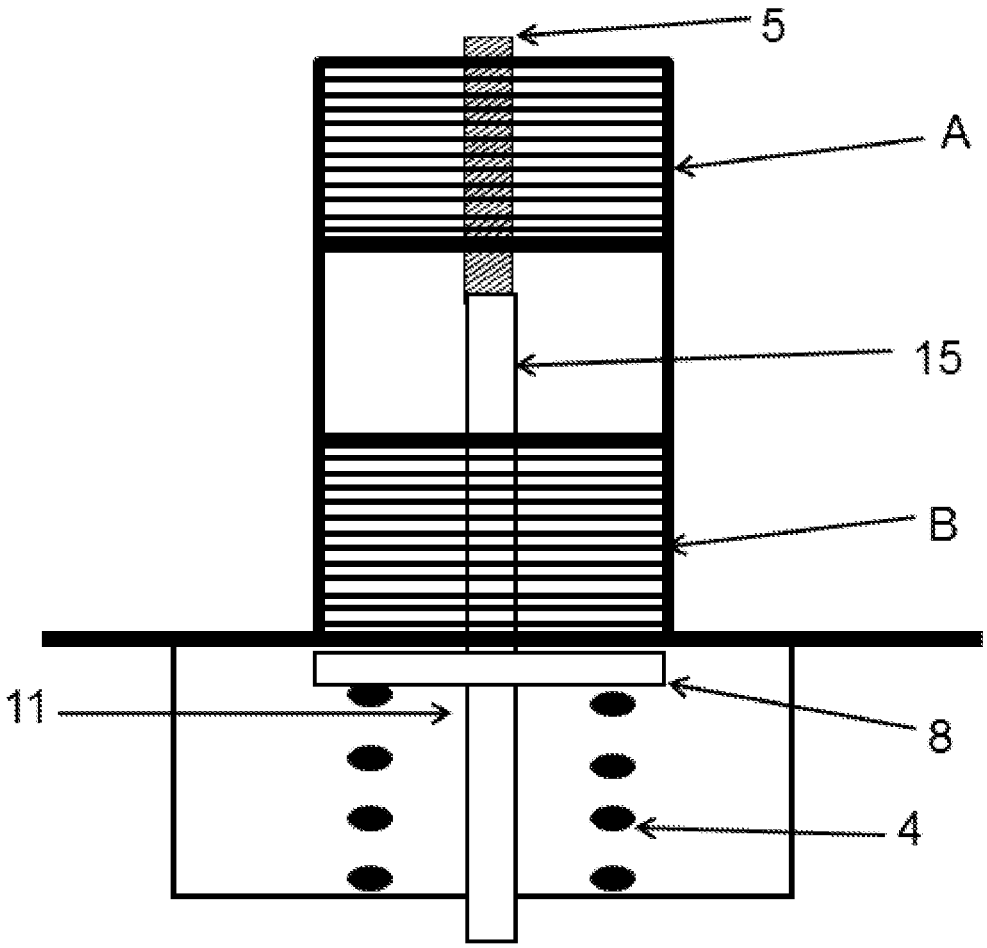

FIG. 5 shows two solenoids A and B. A plunger 5 is present in solenoid A and a plunger 15 is present in solenoid B. The plunger 5 rests on the plunger 15. The plunger 15 in turn rests on the spring washer 8 which is attached to the valve stem 11. The spring 4 is tensioned towards the spring washer and keeps the not shown valve disc in the not shown valve seat etc. It is understood that only an upper portion of the valve stem 11 is shown in FIG. 5-9, i.e. the valve stem is shown cut off right below the actuator.

Solenoid B shall have a stroke which corresponds to how much the engine valve is to open (lift height), for instance 8 mm. The stroke of the plunger 15 is then 8 mm. Solenoid A shall have a stroke which is substantially shorter, for example 4 mm. The stroke of the plunger 5 is then 4 mm. Generally, the properties of solenoids are such that they are weak in the beginning of the plungers movement from the outskirt of the surrounding magnetic field and grows increasingly stronger as the plunger moves into the magnetic field to a stop in the solenoid when the plunger is completely surrounded by the magnetic field. Solenoid A has a short stroke and is, compared to solenoid B, strong already at the start of activation. Solenoid B alone could be activated to push the spring washer 8 by means of the plunger 15 and thereby open the engine valve in a certain time. But compared to A, B is weak during the start of activation and the opening is thus slow.

The invention is characterized in that by activating the solenoid together, the opening of the engine valve can take place faster and with less overall consumption of electric energy compared to if solenoid B alone would be used to open the engine valve.

Figure 6:
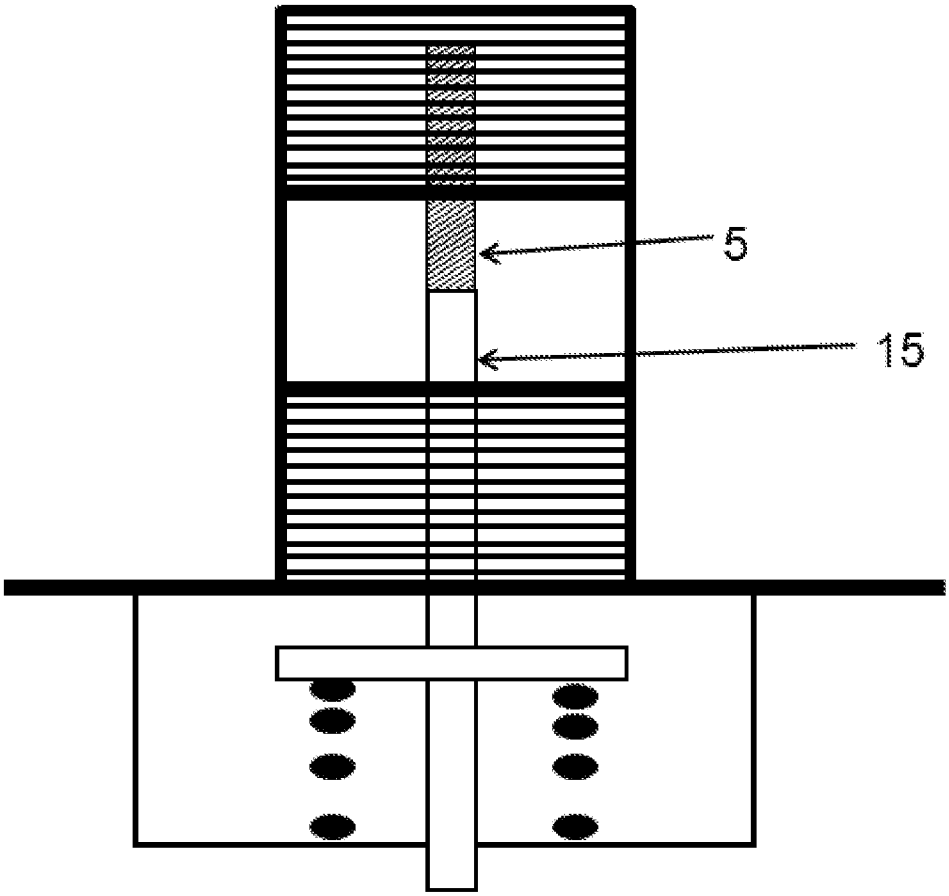

FIG. 6 shows that both solenoids A and B are activated. The spring 4 has at accelerating rate begun to compress since the overall force from plungers 5 and 15 act on the spring washer 8. The not shown valve disc has very quickly left the not shown valve seat. The strong and greatly increasing strength during the relative short movement of plunger 5 acting on the plunger 15 is here referred to as "soft hammer". The impact which takes place in the description of FIG. 2, referred to as the "hammer effect" causes more noise and greater mechanical stress compared to the present invention.

Figure 7:
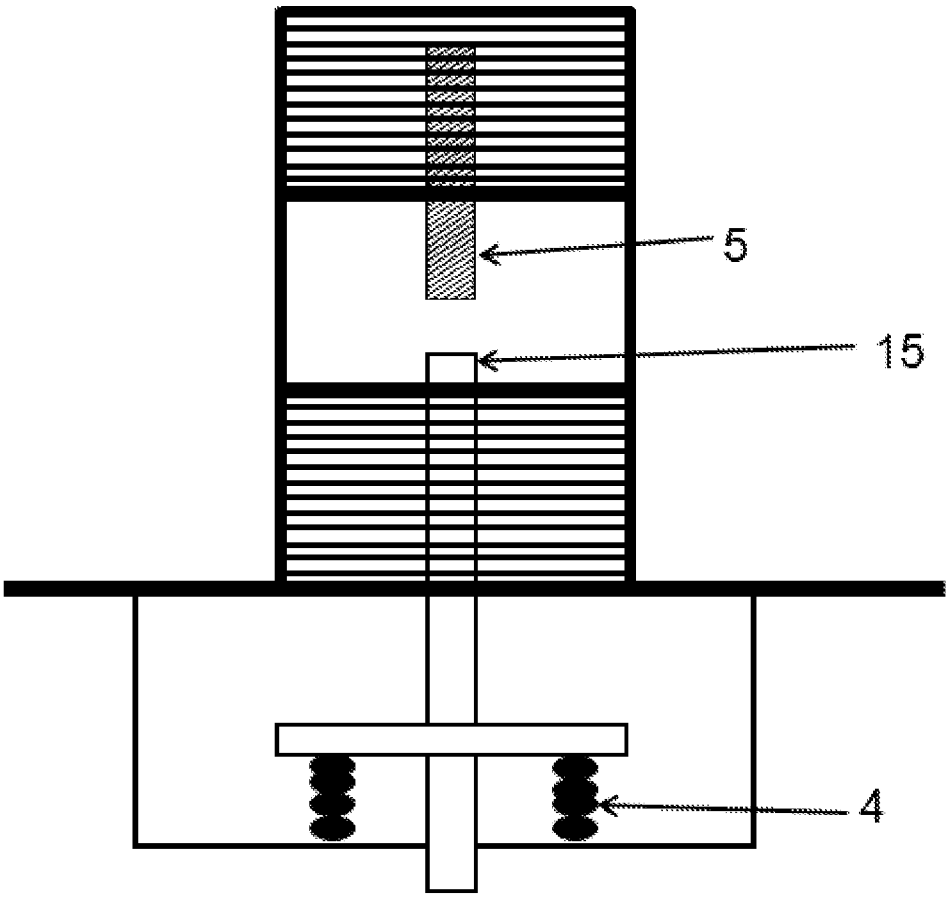

FIG. 7 shows a position where the plunger 5 has reached its stop in solenoid A, and the plunger can therefore not act on the plunger 15, which continues to be displaced in solenoid B until it has reached its stop. The spring 4 is compressed and the not shown engine valve has opened. Solenoid B is at its strongest and can keep the not shown engine valve in open position until it is to be closed.

Figure 8:
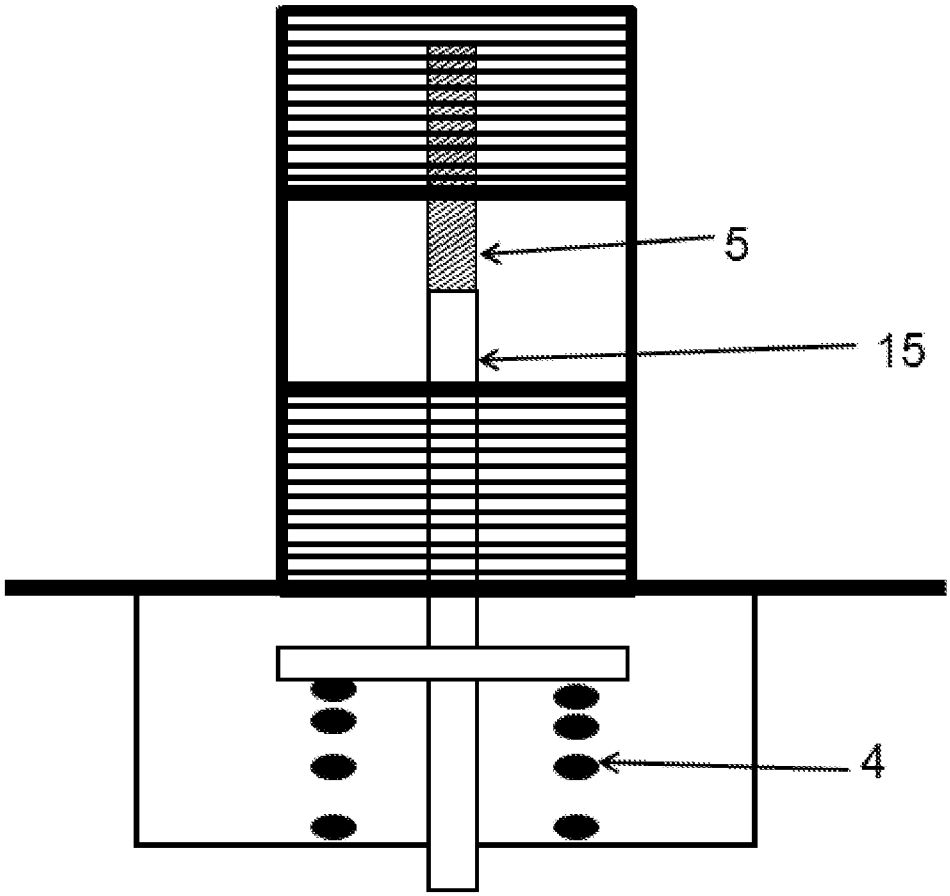

FIG. 8 shows the engine valve during a closing motion caused by deactivation of solenoid B. Spring 4 has to a certain extent expanded, and the plunger 15 has made contact with plunger 5 which has remained in the position shown in FIG. 7. When said contact is made, the movement of the not shown engine valve is retarded and both plunger 5 and 15 continue together with the movement of the engine valve towards a fully closed position.

Figure 9:
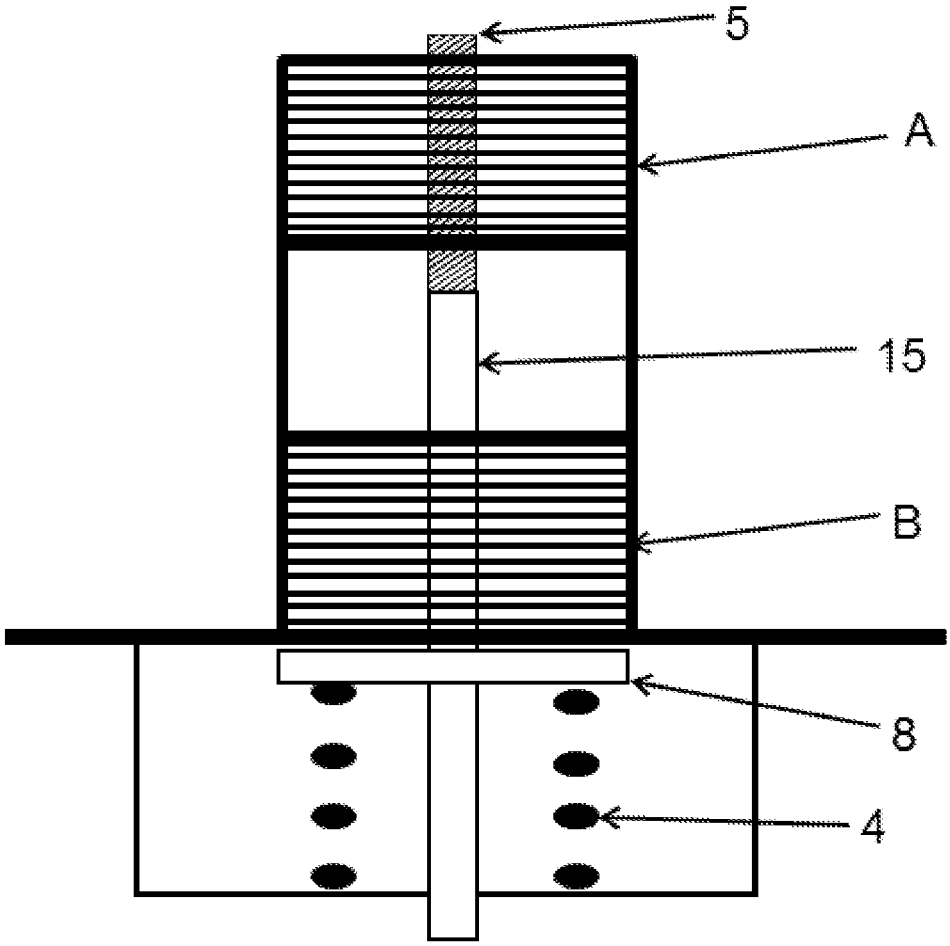

FIG. 9 shows the not shown engine valve in a closed position as in FIG. 5. Just before completed closing, solenoid A has very briefly been activated and thereby retarded the closing movement with the result that the not shown valve disc lands in the not shown valve seat at a speed which does not cause damage to these details.

Figure 10:
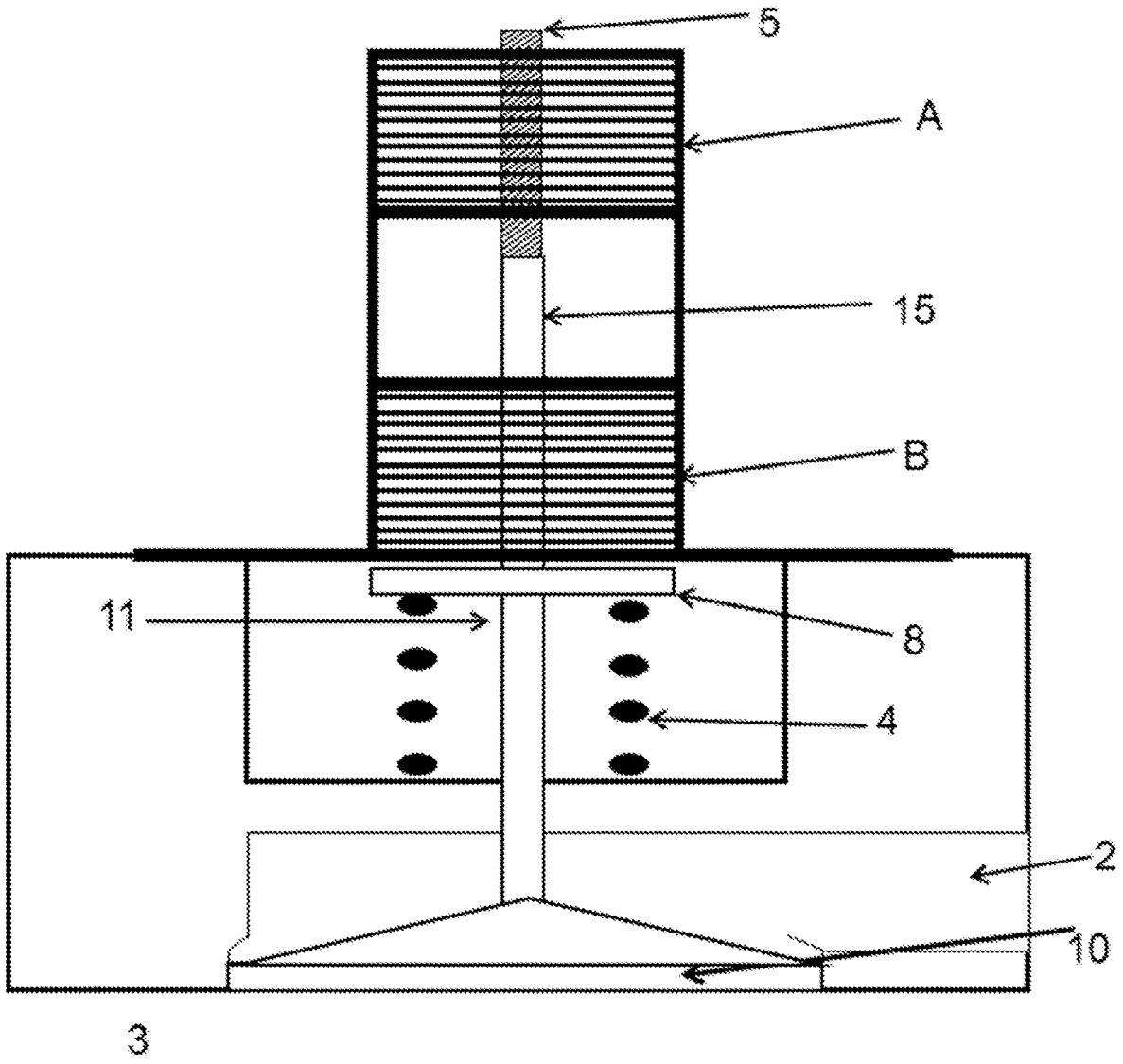

FIG. 10 shows the solenoids A and B with respective plunger 5, 15 in the same position as in FIG. 5. The difference relative FIG. 5 is that the valve actuator is shown here together with the cylinder head 1 with a channel 2, (upper portion of) a combustion chamber 3, a valve disc 10 and valve stem 11 in its entirety (in a corresponding manner as in FIG. 1-4). FIG. 10 could also be considered illustrating an embodiment of a valve arrangement according to the fourth aspect of the invention, or alternatively parts of an embodiment of a combustion engine according to the fifth aspect of the invention.

The invention is not limited to the above described embodiments, but modifications can be made within the scope of the following claims.

The invention claimed is:

1. A method for electrically controlling a valve actuator in a 2-stroke or 4-stroke combustion engine, where the actuator comprises a first solenoid with a first plunger and a second solenoid with a second plunger, wherein said solenoids are arranged in series with each other, wherein the engine has at least one cylinder with at least one freely controllable engine valve comprising a valve disc with an associated valve stem and a valve spring arranged to keep the engine valve closed, wherein air is introduced, or exhaust gases are evacuated from, a combustion chamber past a lower part of the valve stem with the valve disc via at least one channel in the cylinder, wherein the method comprises:

activating the valve actuator to open the engine valve by overcoming the closing force of said valve spring, wherein activating the valve actuator comprises activating both the first and the second solenoid during opening of the engine valve.

2. The method of claim 1, wherein the first plunger of the first solenoid and the second plunger of the second solenoid together act on the valve stem during initial opening of the engine valve.

3. The method of claim 2, wherein said first and second plungers are each provided with a stop defined as a position at which a force of the respective solenoid on the plunger is at a maximum, and wherein when the first plunger has reached the stop in the first solenoid, the second solenoid continues to act on the valve stem until the second plunger has reached the stop in the second solenoid.

4. The method of claim 1, wherein the first solenoid has a shorter stroke and greater strength than the second solenoid.

5. The method of claim 1, comprising activating said first solenoid just before the engine valve reaches a valve seat, such that a closing movement is retarded.

6. The method of claim 2, comprising activating said first solenoid just before the engine valve reaches a valve seat, such that a closing movement of the engine valve is retarded.

7. The method of claim 4, comprising activating said first solenoid just before the engine valve reaches a valve seat, such that a closing movement of the engine valve is retarded.

8. A device for electrically controlling a valve actuator in a 2-stroke or 4-stroke combustion engine, where the actuator comprises a first solenoid with a first plunger and a second solenoid with a second plunger, wherein the engine has at least one cylinder with at least one freely controllable engine valve comprising a valve disc with associated valve stem and a valve spring arranged to keep the valve closed, wherein air is introduced, or exhaust gases are evacuated from, a combustion chamber past a lower part of the valve stem with the valve disc via at least one channel in the cylinder, wherein the valve actuator is activatable to open the engine valve by overcoming the force of said valve spring, wherein the device is configured to activate both the first solenoid and the second solenoid during opening of the engine valve.

9. The device of claim 8, wherein the first plunger of the first solenoid and the second plunger of the second solenoid are arranged to act together on the valve stem during initial opening of the engine valve.

10. The device of claim 9, wherein said first and second plunger are each provided with a stop defined as a position at which a force of the respective solenoid on the plunger is at a maximum, wherein the second plunger is arranged to, after the first plunger has reached the stop in the first solenoid, continue to act on the valve stem until the second plunger has reached the stop in the second solenoid.

11. The device of claim 8, wherein the first solenoid has a shorter stroke and greater strength than the second solenoid.

12. The device of claim 8, wherein the device is configured to activate said first solenoid just before the engine valve reaches a valve seat, such that a closing movement is retarded.

13. The device of claim 11, wherein the device is configured to activate said first solenoid just before the engine valve reaches a valve seat, such that a closing movement of the engine valve is retarded.

14. A combustion engine comprising:

at least one cylinder with at least one freely controllable engine valve comprising:

a valve disc with associated valve stem, and a valve spring arranged to keep the valve closed, wherein air is introduced, or exhaust gases are evacuated from, a combustion chamber past a lower part of the valve stem with the valve disc via at least one channel in the cylinder, wherein the combustion engine comprises a valve actuator comprising a first solenoid with a first plunger and a second solenoid with a second plunger, wherein said solenoids are arranged in series, wherein the valve actuator is arranged and activatable to open the engine valve by overcoming the force of said valve spring, and wherein the combustion engine comprises a device configured to electrically control the valve actuator by activating both the first solenoid and the second solenoid during opening of the engine valve.

15. The combustion engine of claim 14, wherein the first plunger of the first solenoid and the second plunger of the second solenoid are arranged to act together on the valve stem during initial opening of the engine valve.

16. The combustion engine of claim 15, wherein the first plunger is provided with a first stop at a position at which a force of the first solenoid on the first plunger is at a maximum, wherein the second plunger is provided with a second stop defined at a position at which a force of the second solenoid is at a maximum, and wherein the second plunger is configured to continue to act on the valve stem after the first plunger has reached the first stop until the second plunger has reached the second stop.

17. The combustion engine of claim 14, wherein the first solenoid has a shorter stroke and greater strength than the second solenoid.

18. The combustion engine of claim 15, wherein the first solenoid has a shorter stroke and greater strength than the second solenoid.

19. The combustion engine of claim 14, wherein the device is configured to activate the first solenoid just before the engine valve reaches a valve seat, such that a closing movement of the engine valve is retarded.

20. The combustion engine of claim 19, wherein the device is configured to activate the first solenoid just before the engine valve reaches a valve seat, such that a closing movement of the engine valve is retarded.

* * * * *